US005887856A

United States Patent [19]

Everly, II

[11] Patent Number: 5,887,856

[45] Date of Patent: Mar. 30, 1999

[54] ILLUMINATED FENCE SYSTEM

[76] Inventor: Robert J. Everly, II, R.R. 4 Box 4032, Spring Grove, Pa. 17362

[21] Appl. No.: 888,263

[22] Filed: Jul. 3, 1997

[51] Int. Cl.[6] ..... E04H 17/00

[52] U.S. Cl. ..... 256/1; 256/65; 362/152; 362/276; 362/576

[58] Field of Search ..... 362/152, 146, 362/276, 802, 145, 576, 225; 404/6, 9, 15; 256/1, 59, 65, 13.1

[56] References Cited

U.S. PATENT DOCUMENTS

| | | | |
|---|---|---|---|
| 2,825,796 | 3/1958 | Lanmon | 362/152 |
| 3,057,991 | 10/1962 | Grenadier | 362/146 |
| 3,687,493 | 8/1972 | Lock et al. | 285/333 |
| 5,099,402 | 3/1992 | Starniri | 362/146 |
| 5,118,910 | 6/1992 | Duhon et al. | 362/146 X |
| 5,489,891 | 2/1996 | Diong et al. | 362/802 X |
| 5,575,557 | 11/1996 | Huang et al. | 362/276 |
| 5,683,170 | 11/1997 | Blaha | 362/152 X |
| 5,701,236 | 12/1997 | Viviano | 362/152 |

*Primary Examiner*—Harry C. Kim
*Assistant Examiner*—David E. Bochna

[57] ABSTRACT

A new Illuminated Fence System for providing lighting in a fence such that the light is activated upon command by a sensor. The inventive device includes modular, prefabricated fence system, which includes a plurality of uprights and rail sections. The uprights feature slots on their sides that can be fitted with clear or tinted lenses. Disposed in these members are lighting apparatus.

15 Claims, 4 Drawing Sheets

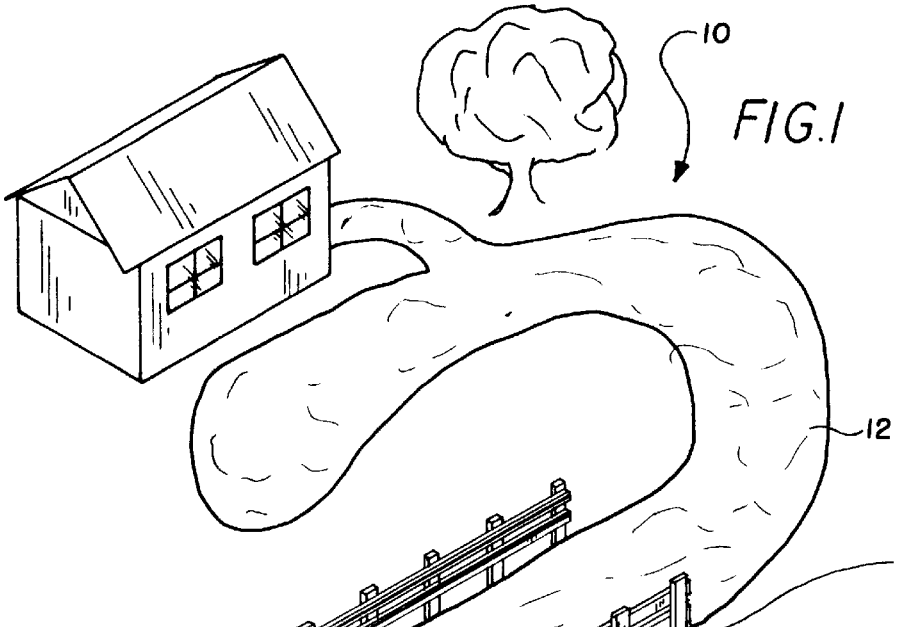
FIG.1
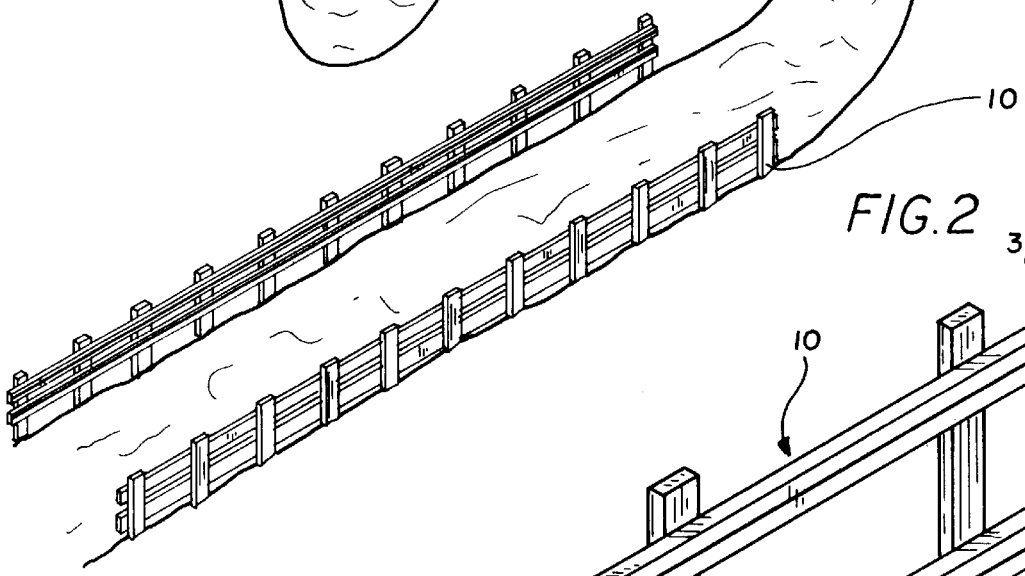
FIG.2
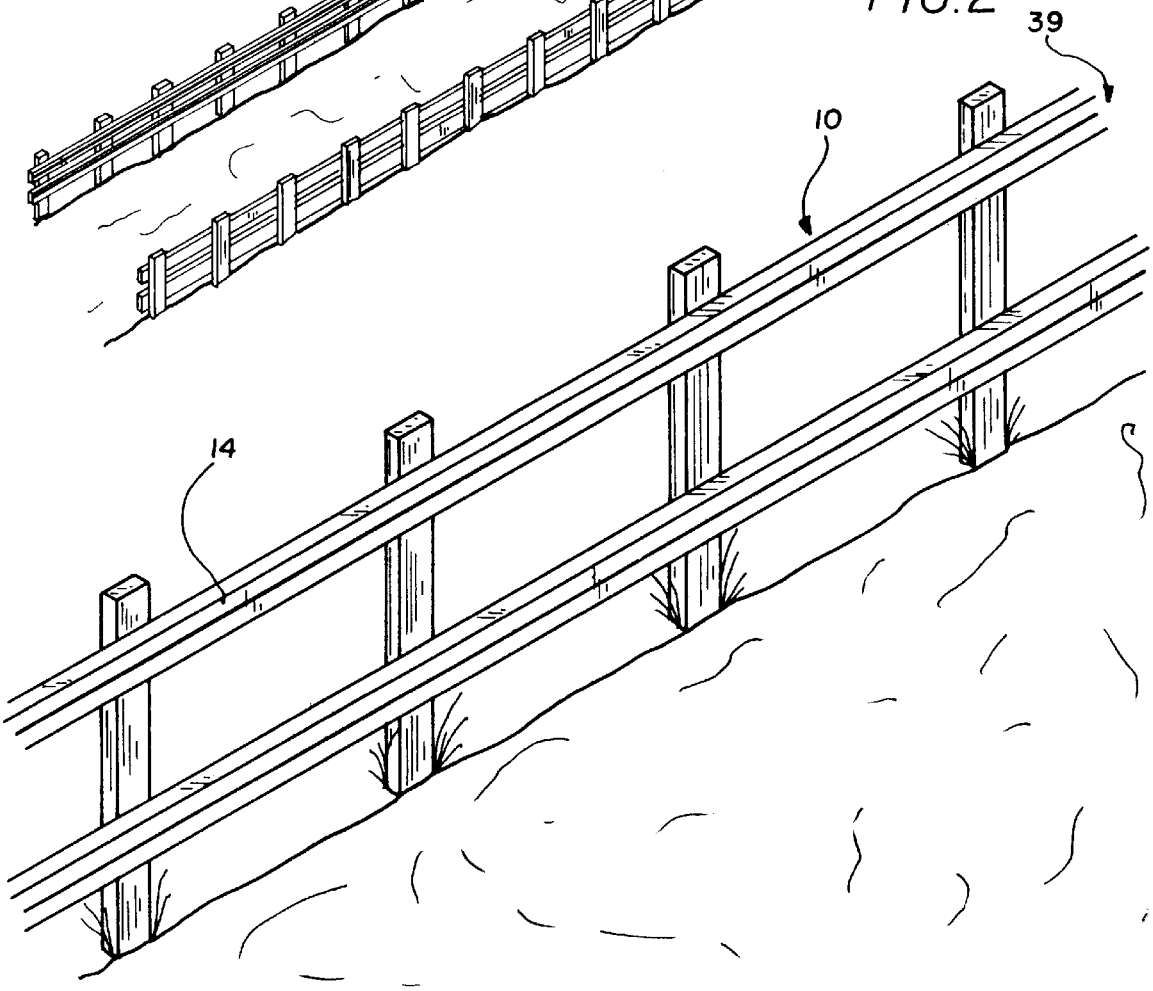

ILLUMINATED FENCE SYSTEM

BACKGROUND OF THE INVENTION

1. Field of the Invention

The present invention relates to fence assemblies and more particularly pertains to a new Illuminated Fence System for providing lighting in a fence such that the light is activated upon command by a sensing means.

2. Description of the Prior Art

The use of fence assemblies is known in the prior art. More specifically, fence assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art fence assemblies include U.S. Pat. No. 4,357,000; U.S. Pat. No. 5,429,340; U.S. Pat. No. 4,371,869; U.S. Pat. No. 5,436,811; U.S. Pat. No. 273,333.

While these devices fulfill their respective, particular objectives and requirements, the aforementioned patents do not disclose a new Illuminated Fence. The inventive device includes modular, prefabricated fence system, which includes a plurality of uprights and rail sections. The uprights feature slots on their sides that can be fitted with clear or tinted lenses. Disposed in these members are lighting means.

In these respects, the Illuminated Fence Systemaccording to the present invention substantially departs from the conventional concepts and designs of the prior art, and in so doing provides an apparatus primarily developed for the purpose of providing lighting in a fence such that the light is activated upon command by a sensing means.

SUMMARY OF THE INVENTION

In view of the foregoing disadvantages inherent in the known types of fence assemblies now present in the prior art, the present invention provides a new Illuminated Fence Systemconstruction wherein the same can be utilized for providing lighting in a fence such that the light is activated upon command by a sensing means.

The general purpose of the present invention, which will be described subsequently in greater detail, is to provide a new Illuminated Fence Systemapparatus and method which has many of the advantages of the fence assemblies mentioned heretofore and many novel features that result in a new Illuminated Fence Systemwhich is not anticipated, rendered obvious, suggested, or even implied by any of the prior art fence assemblies, either alone or in any combination thereof.

To attain this, the present invention generally comprises modular, prefabricated fence system, which includes a plurality of uprights and rail sections. The uprights feature slots on their sides that can be fitted with clear or tinted lenses. Disposed in these members are lighting means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Illuminated Fence Systemapparatus and method which has many of the advantages of the fence assemblies mentioned heretofore and many novel features that result in a new Illuminated Fence Systemwhich is not anticipated, rendered obvious, suggested, or even implied by any of the prior art fence assemblies, either alone or in any combination thereof.

It is another object of the present invention to provide a new Illuminated Fence Systemwhich may be easily and efficiently manufactured and marketed.

It is a further object of the present invention to provide a new Illuminated Fence Systemwhich is of a durable and reliable construction.

An even further object of the present invention is to provide a new Illuminated Fence Systemwhich is susceptible of a low cost of manufacture with regard to both materials and labor, and which accordingly is then susceptible of low prices of sale to the consuming public, thereby making such Illuminated Fence Systemeconomically available to the buying public.

Still yet another object of the present invention is to provide a new Illuminated Fence System which provides in the apparatuses and methods of the prior art some of the advantages thereof, while simultaneously overcoming some of the disadvantages normally associated therewith.

Still another object of the present invention is to provide a new Illuminated Fence System for providing lighting in a fence such that the light is activated upon command by a sensing means.

Yet another object of the present invention is to provide a new Illuminated Fence System which includes modular, prefabricated fence system, which includes a plurality of uprights and rail sections. The uprights feature slots on their sides that can be fitted with clear or tinted lenses. Disposed in these members are lighting means.

Still yet another object of the present invention is to provide a new Illuminated Fence System which can be made of hollow plastic and can be connected by sliding projections into similarly sided receptacles.

Even still another object of the present invention is to provide a new Illuminated Fence System that allows for a variety of lighting means such as fluorescent lighting or fiber optic strands.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a new Illuminated Fence System according to the present invention.

FIG. 2 is a side perspective view of the fence.

DESCRIPTION OF THE PREFERRED EMBODIMENT

Figure 3:
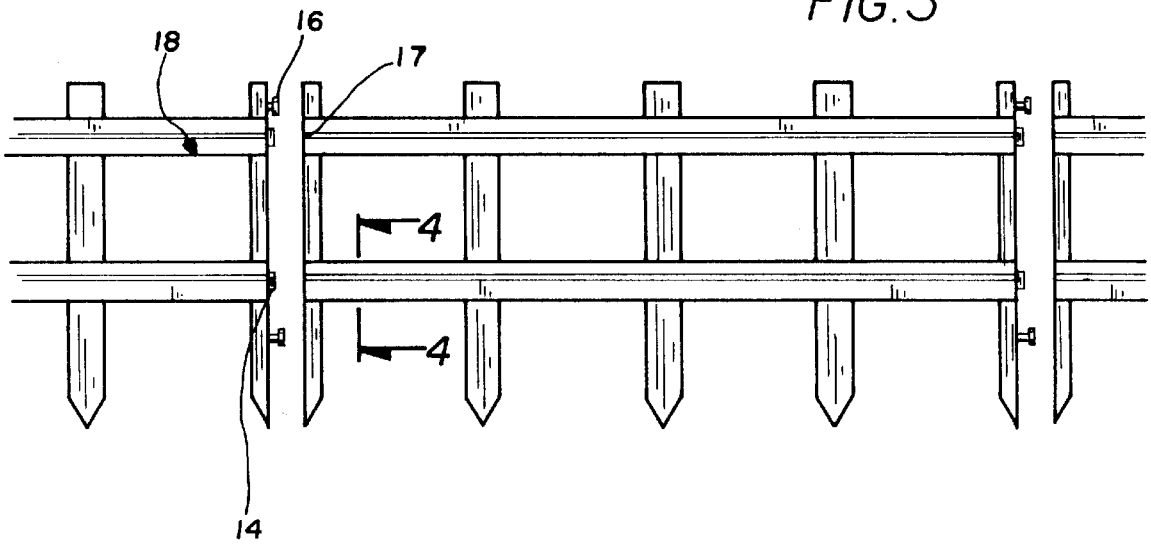
FIG. 3 is an exploded illustration of the present invention.

With reference now to the drawings, and in particular to FIGS. 1 through 8 thereof, a new Illuminated Fence Systemembodying the principles and concepts of the present invention and generally designated by the reference numeral 10 will be described.

More specifically, it will be noted that the Illuminated Fence System10 comprises modular, prefabricated fence system, which includes a plurality of elongate vertical posts 38 and elongate horizontal cross members 39 formed of hollow modular prefabricated plastic. Each of the vertical posts is designed to resemble a vertical bisected 4 inches by 4 inches post and the horizontal cross members resemble a rail for a fence which measures at least about 6 ft in length.

Each of the vertical posts has an aperture formed on a side with a light generating means 22 disposed in the aperture.

Each of the horizontal cross members has a side forming a substantially planar front face lying in a viewing plane. The front face of each of the horizontal cross members has an elongate bore 15 that extends along the length of the front face of the horizontal cross member. Each of the bores has a generally circular transverse cross section. Each of the bores has a portion of the circular transverse cross section intersecting a face of the horizontal cross members and being in communication with exterior surfaces of the horizontal cross members to form a slot with an interior visible only from a position forward of the plane of the front face.

Figure 4:
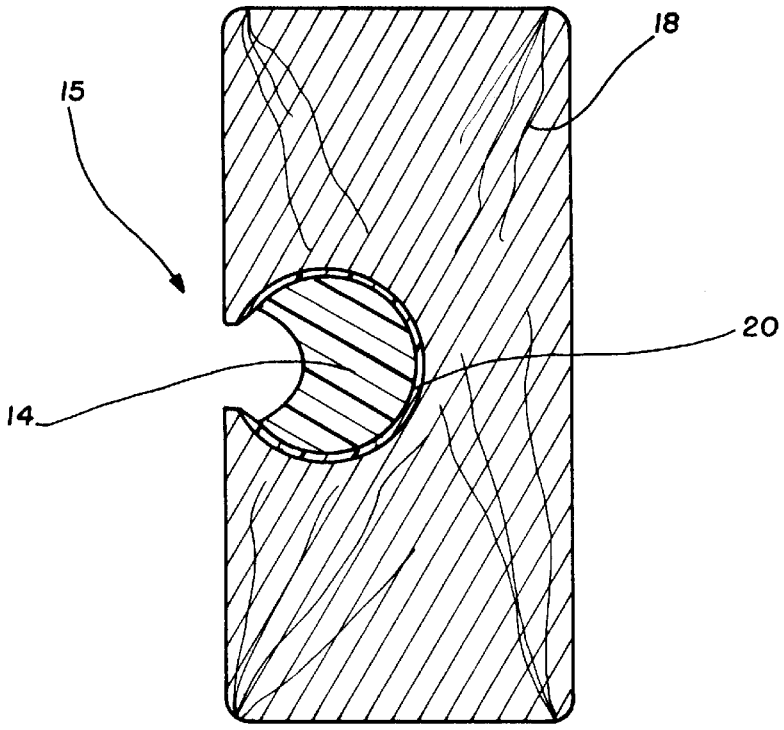
FIG. 4 is a cross sectional view taken along line 4—4 of FIG. 3.

Each of the bores has an elongate solid lens 14 disposed therein. Each of the lenses is generally tubular with a generally circular transverse cross section. As shown in FIG. 4, each of the lenses has a groove that extends along the length thereof. Each of the grooves has a concavity extending outwardly. Each of the lenses may comprise acrylic and be tinted. A plastic casing 20 may also be disposed between the lens and an inner surface of each of the bores. The lenses extend into the apertures of the vertical posts with free ends of the lenses being positioned adjacent the light generating means.

The light generating means comprises a generally pear-shaped light bulb. Each of the free ends of the lenses are curved to follow the countour of an outer surface of the pear-shaped light bulb.

A bulb protection means 26 covers each of the apertures of the vertical posts. Preferably, the bulb protection means comprises a door.

Figure 5:
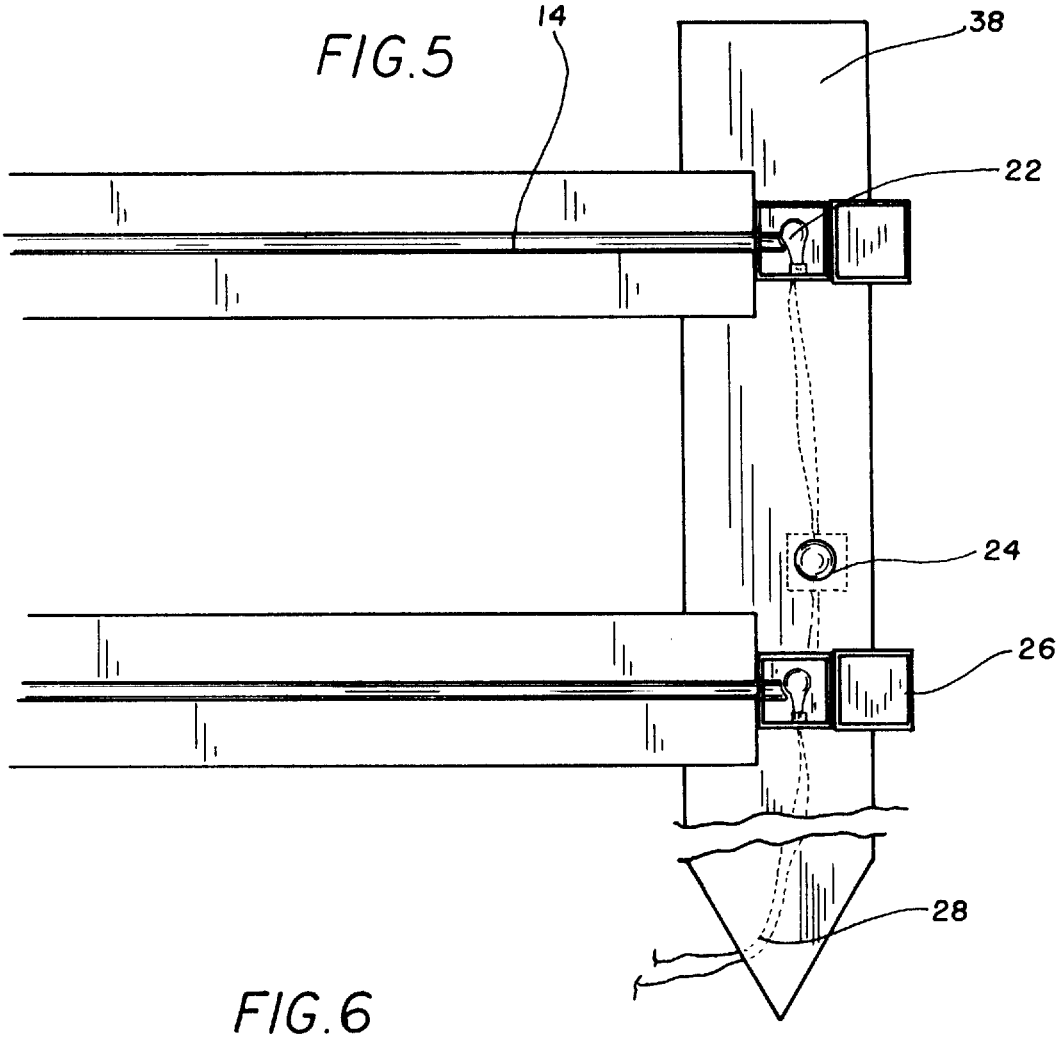
FIG. 5 is an exploded view of the lighting features of the present invention.
Figure 6:
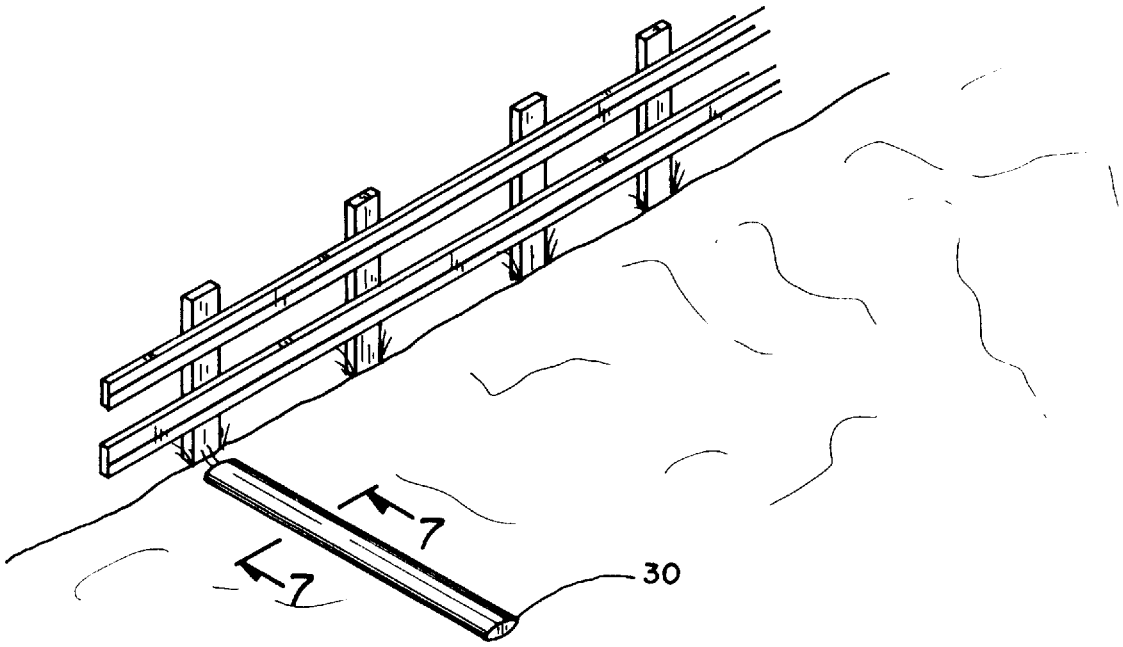
FIG. 6 is a front view of the fence of the present invention showing the pressure pad used to activate the lighting system.
Figure 7:
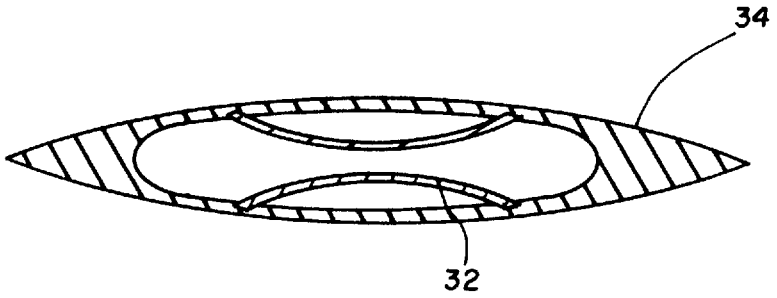
FIG. 7 is a cross sectional view taken along line 7—7 of FIG. 6.

A sensing means 24 communicates with the light generating means through a wire, as shown in FIG. 5. The sensing means activates the light generating means. A pressure sensor 30 may also communicate with the light generating means through a wire 28. The pressure sensor would be located in a drive way 12 of a home or business. Preferably, the lighting means has a timer 68 and a dimmer switch (not shown).

The lighting means 22 can form a relationship with a pressure sensor 30 located in a drive way of a home or business. The lighting means 22 can also communicate with a remote sensing beam located on either a vehicle, a house, a building or a driveway. Not shown in the figures is a possible dimmer switch. As it is know in the art, dimmer switches are used at the convenience of the user to dim lights when necessary. This technology is well known in the art and will not be described herein. The lighting means 22 can further have a relationship with a timer. The timer would serve to time how long the lighting means 22 stays on once activated. A plurality of wires 28 is generally used to direct the power source 40 to the lighting means 22, the sensing means 24, the pressure sensor 30 and the timer 48.

Figure 8:
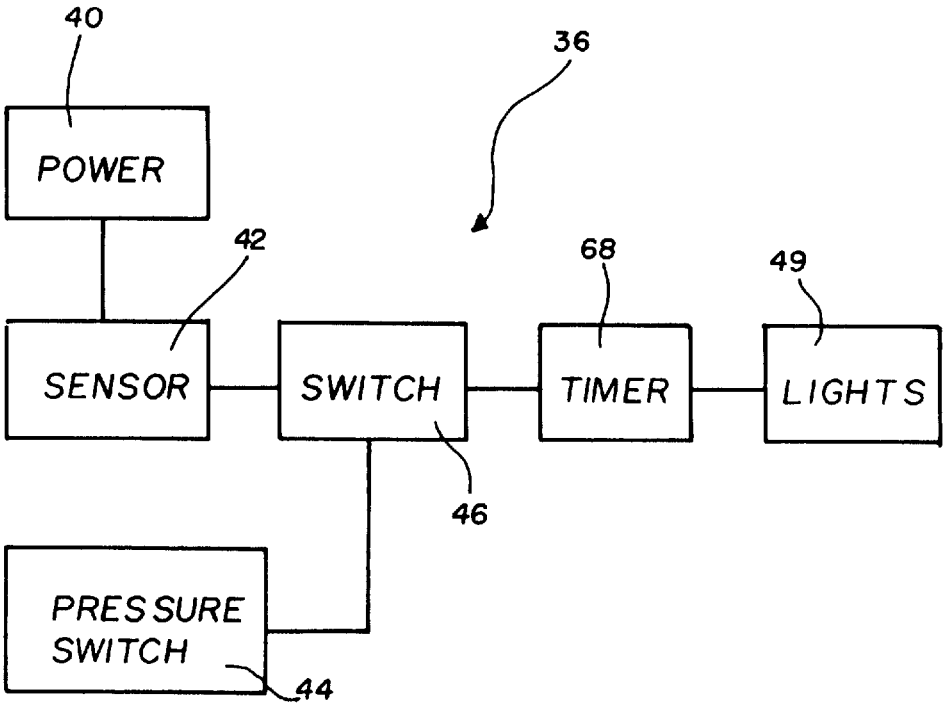
FIG. 8 is a flow chart of the operation system of the present invention.

FIG. 8 sets forth a flow chart 36 of the operation system. The power source 40 relates to the sensor 42 which in turn communicates with the switch 46. The switch 46 also forms a relationship with the pressure switch 44. The switch 46 relates to the timer 48 which interrelates with the lights 49.

The horizontal sections 39 comprises male fence connectors 16 and female fence connectors 17. The male fence connectors 16 are adapted to fit with the female fence connectors 17 to form a snap-fit connection. The male fence connectors 16 and female fence connectors 17 can be sealed together by a sealant intended to keep out moisture. Although any sealant can be used to maintain the desired results, the preferred sealant of the present invention are neoprene rubber "O" rings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An illuminated fence system comprising:

a plurality of elongate vertical posts and elongate horizontal cross members formed of hollow modular prefabricated plastic;

each of the vertical posts having an aperture formed on a side with a light generating means disposed in said aperture;

wherein each of the horizontal cross members has a side forming a substantially planar front face defining a viewing plane, the front face of each of the horizontal cross members having an elongate bore extending along the longitudinal extent of the front face of said horizontal cross member, wherein each of said bores has a generally circular transverse cross section, each of said bores having a portion of said generally circular transverse cross section intersecting the front face of said horizontal cross member and being in communication with exterior surfaces of the horizontal cross members to form a slot with an interior visible only from a position forward of the plane of said front face;

each of said bores having an elongate solid lens disposed therein such that said lens does not protrude beyond the plane of said front face; said lenses being extended into said apertures of said vertical posts, free ends of said lenses being positioned adjacent said light generating means; and a sensing means, said sensing means communicating with said light generating means through a wire, said sensing means activating said light generating means.

2. The illuminated fence system of claim 1, wherein each of the horizontal cross members forms a hollow section on a side, said hollow section having a sealed relationship with a plastic casing, and each of said lenses comprises acrylic.

3. The illuminated fence system of claim 1, wherein each of said lenses comprises a clear material for allowing light to shine through.

4. The illuminated fence system of claim 1, wherein each of said lenses comprises a tinted translucent material.

5. The illuminated fence system of claim 1 wherein each of the cross members comprises a hollow section that forms an elongated segment throughout the length of said horizontal cross members, said light generating means comprises a generally pear-shaped light bulb, each of said free ends of said lenses being curved to follow the countour of an outer surface of the pear-shaped light bulb.

6. The illuminated fence system of claim 1, wherein each of the lenses being generally tubular with a generally circular transverse cross section, each of the lenses having a groove extending along the length thereof, each of said grooves having a concavity extending outwardly.

7. The illuminated fence system of claim 1, wherein the vertical posts are designed to resemble a vertical bisected 4 inches by 4 inches post and the horizontal cross member resembles a rail for a fence which measures at least about 6 ft in length.

8. The illuminated fence system of claim 1, wherein the light generating means are selected from a group consisting of, light bulbs, florescent tubes and fiber optics means.

9. The illuminated fence system of claim 1, wherein a bulb protection means covers each of said apertures of said vertical posts.

10. The illuminated fence system of claim 9, wherein the bulb protection means forms a door.

11. The illuminated fence system of claim 1, wherein the light generating means is in communication with a pressure sensor located in a drive way of a home or business through a wire.

12. The illuminated fence system of claim 1, wherein a plastic casing is disposed between said lens and an inner surface of each of said bores.

13. The illuminated fence system of claim 1, wherein the light generating means comprises a timer.

14. The illuminated fence system of claim 1, wherein the light generating means comprises a dimmer switch.

15. An illuminated fence system comprising:

a plurality of elongate vertical posts and elongate horizontal cross members formed of hollow modular prefabricated plastic, each of the vertical posts being designed to resemble a vertical bisected 4 inches by 4 inches post and the horizontal cross members resemble a rail for a fence which measures at least about 6 ft in length;

each of the vertical posts having an aperture formed on a side with a light generating means disposed in said aperture;

wherein each of the horizontal cross members has a side forming a substantially planar front face defining a viewing plane, the front face of each of the horizontal cross members having an elongate bore extending along the longitudinal extent of the front face of said horizontal cross member, wherein each of said bores has a generally circular transverse cross section, each of said bores having a portion of said generally circular transverse cross section intersecting the front face of said horizontal cross member and being in communication with exterior surfaces of the horizontal cross members to form a slot with an interior visible only from a position forward of the plane of said front face;

each of said bores having an elongate solid lens disposed therein, each of said lenses comprises acrylic and being tinted;

each of said lenses being generally tubular with a generally. circular transverse cross section, each of the lenses having a groove extending along the length thereof, each of said grooves having a concavity extending outwardly;

a plastic casing being disposed between said lens and an inner surface of each of said bores;

said lenses being extended into said apertures of said vertical posts, free ends of said lenses being positioned adjacent said light generating means;

a bulb protection means covering each of said apertures of said vertical posts, said bulb protection means comprising a door;

said light generating means comprising a generally pear-shaped light bulb, each of said free ends of said lenses being curved to follow the countour of an outer surface of the pear-shaped light bulb;

a sensing means communicating with said light generating means through a wire, said sensing means activating said light generating means;

a pressure sensor communicating with said light generating means through a wire, said pressure sensor being located in a drive way of a home or business;

said light generating means having a timer; and said light generating means having a dimmer switch.

* * * * *